US011222738B2

(12) United States Patent
Kim et al.

(10) Patent No.: US 11,222,738 B2
(45) Date of Patent: Jan. 11, 2022

(54) METHOD FOR MANUFACTURING RARE EARTH MAGNET

(71) Applicant: STAR GROUP IND. CO., LTD, Daegu (KR)

(72) Inventors: Dong Hwan Kim, Daegu (KR); Koon Seung Kong, Daegu (KR)

(73) Assignee: STAR GROUP IND. CO., LTD, Daegu (KR)

( * ) Notice: Subject to any disclaimer, the term of this patent is extended or adjusted under 35 U.S.C. 154(b) by 563 days.

(21) Appl. No.: 16/099,461

(22) PCT Filed: Jun. 10, 2016

(86) PCT No.: PCT/KR2016/006176
§ 371 (c)(1),
(2) Date: Nov. 7, 2018

(87) PCT Pub. No.: WO2017/209332
PCT Pub. Date: Dec. 7, 2017

(65) Prior Publication Data

US 2019/0198209 A1 Jun. 27, 2019

(30) Foreign Application Priority Data

May 30, 2016 (KR) ..... 10-2016-0066570

(51) Int. Cl.
*H01F 1/08* (2006.01)
*H01F 1/057* (2006.01)
(Continued)

(52) U.S. Cl.
CPC ..... *H01F 1/08* (2013.01); *B22F 3/087* (2013.01); *H01F 1/0577* (2013.01); *H01F 1/086* (2013.01);
(Continued)

(58) Field of Classification Search
CPC .... B22F 2999/00; B22F 3/02; B22F 2202/05; B22F 3/10; B22F 2301/355; B22F 3/087;
(Continued)

(56) References Cited

U.S. PATENT DOCUMENTS 6,143,094 A * 11/2000 Sugiyama ..... C21D 7/02 148/120
2013/0252004 A1* 9/2013 Maeda ..... C22C 38/001 428/457

FOREIGN PATENT DOCUMENTS

JP 61-78105 A 4/1986
JP 06-168807 A 6/1994
(Continued)

*Primary Examiner* — Jie Yang
(74) *Attorney, Agent, or Firm* — Novick, Kim & Lee, PLLC; Jae Youn Kim

(57) ABSTRACT

The present invention provides a method for manufacturing a rare-earth magnet, the method comprising the steps of preparing a rare-earth magnet raw material powder including R, Fe and B as composition components (R is one or more elements selected from the rare earth elements including Y and Sc); packing the raw material powder into a molding die, and compacting and molding the raw material powder while applying a magnetic field, wherein, in the compacting and molding step, compacting is performed biaxially, in the directions of X and Y axes, when the magnetic field is applied in the direction of Z axis.

5 Claims, 6 Drawing Sheets

(51) Int. Cl.
*H01F 41/02* (2006.01)
*B22F 3/087* (2006.01)

(52) U.S. Cl.
CPC ..... *H01F 41/0266* (2013.01); *H01F 41/0273* (2013.01); *B22F 2301/355* (2013.01); *B22F 2998/10* (2013.01); *B22F 2999/00* (2013.01)

(58) Field of Classification Search
CPC ..... C22C 2202/02; H01F 1/0577; H01F 1/08; H01F 1/086; H01F 41/0266; H01F 41/0273
USPC ..... 148/105
See application file for complete search history.

(56) References Cited

FOREIGN PATENT DOCUMENTS

| | | | |
|---|---|---|---|
| JP | 10-102140 | A | 4/1998 |
| JP | 2003-073786 | A | 3/2003 |
| JP | 2005-259977 | A | 9/2005 |
| JP | 2014-57075 | A | 3/2014 |
| KR | 10-2006-0093939 | A | 8/2006 |
| KR | 10-1585479 | B1 | 1/2016 |

* cited by examiner

METHOD FOR MANUFACTURING RARE EARTH MAGNET

TECHNICAL FIELD

The present invention relates to a method for manufacturing a rare-earth magnet.

BACKGROUND ART

As the energy saving and eco-friendly green growth projects have been suddenly raised as new issues, active research has been conducted with respect to a hybrid vehicle, which uses in parallel an internal combustion engine using fossil fuel and a motor, or a fuel cell vehicle, which generates electricity by using hydrogen as an eco-friendly energy source as alternative energy and drives a motor by using the generated electricity. Since eco-friendly vehicles have in common the feature of being driven by using electric energy, a permanent magnetic motor and generator are inevitably required. In terms of magnetic materials, the technical demand on a rare-earth sintered magnet having excellent hard magnetic performance has increased to further improve the energy efficiency. Further, in other terms of fuel-efficiency of eco-friendly vehicles besides drive motors, vehicle components, which are used for steering systems, electric parts, etc., need to be light in weight and small in size. For example, to realize a light and small motor, it is necessary to change the multifunctional design of a motor and to replace the permanent magnet material with a rare-earth permanent magnet which has excellent magnetic performance relative to ferrite used previously.

The future production of the aforementioned eco-friendly vehicles is expected to gradually increase on the ground that the policy of regulating carbon emission has been more and more intensified in relation to an increase of oil price caused by an increase of energy use, a solution of health problems caused by environment pollution and a long-term measure of global warming in all areas of the world.

On the other hand, since a permanent magnet used in an eco-friendly vehicle needs to stably maintain its function without losing performance of the magnet in a high temperature environment of 200° C., a high coercivity of 25~30 kOe is required.

Among the variables to improve residual magnetic flux density, the most important variable is to improve alignment in a magnetic field which is an anisotropic process of a rare-earth alloy powder or crystal grains, based on the improvement of a process of manufacturing a rare-earth magnet since the saturated magnetic flux density of a main phase is fixed when the composition of an alloy is determined during the actual process of a rare-earth permanent magnet, and since the density of the magnet which is almost in proximity to a theoretical value is also easily obtained.

Generally, a process of manufacturing a rare-earth permanent magnet comprises the steps of: preparing an alloy including a rare-earth element-Fe—B-other metals by melting and casting processes; pulverizing the alloy to a rare-earth powder with a particle size which is a few μm by a pulverizing method using a ball mill or jet mill, etc.; aligning the powder loaded into a molding die in a uniaxial direction and simultaneously compacting and molding the powder as a compact by applying a magnetic field; and sintering the compact aligned in a magnetic field under a vacuum or in an argon atmosphere to form a densified compact.

According to the conventional alignment technique in a magnetic field, a rare-earth powder is packed into a molding die, to be aligned by a DC magnetic field generated by applying a DC magnetic field to electromagnets positioned at the right and left of the molding die and to be simultaneously compacted and molded as a magnetic field anisotropic compact.

However, as shown in FIG. 1, the conventional art has the problem in that the powder is not uniformly distributed inside the compact since uniaxial molding is performed during the process of compacting and molding in a magnetic field.

DISCLOSURE

Technical Problem

Therefore, it is an object of the present invention to solve the above problems and to provide a rare-earth magnet and a method for manufacturing the same by performing biaxial molding in a process of compacting and molding a raw material powder for the rare-earth magnet in a magnetic field, thereby enabling a uniform distribution of the raw material powder inside a compact and improving the residual magnetic flux density to improve the maximum energy product.

Technical Solution

In accordance with an embodiment of the present invention to achieve the above object, there is provided a method for manufacturing a rare-earth magnet comprising the steps of: preparing a raw material powder for a rare-earth magnetic composed of R, Fe and B (wherein R is at least one element selected from rare-earth elements including Y and Sc); packing the raw material powder into a molding die; and compacting and molding the raw material powder as a compact by forming a magnetic field, wherein, in the compacting and molding step, when the direction of the magnetic field is a Z-axis, the compacting is performed in the directions of an X-axis and an Y-axis.

The compacting and molding step is performed by compacting in the X-axis direction and compacting in the Y-axis direction sequentially by one (1) time.

The compacting and molding step is performed by compacting in the X-axis direction and compacting in the Y-axis direction sequentially and repetitively by two (2) to ten (10) times, respectively.

After the compact is molded, a powder green density is 3.5~4.5 g/cc.

A difference in a ratio of compacting in the X-axis direction to the Y-axis direction is 10% or less.

The packing step is performed within a packing density of 1.0~3.0 g/cc.

An average distance between crystal grains in the X-axis direction is 0.90~1.10 times compared to an average distance between crystal grains in the Y-axis direction.

In accordance with another embodiment of the present invention, there is provided a rare-earth magnet as manufactured by compacting and molding, in a magnetic field, a raw material powder for the rare-earth magnet composed of R, Fe and B, comprising: when a direction of the magnetic field is a Z-axis, an average distance between crystal grains in an X-axis direction which is 0.90~1.10 times compared to an average distance between crystal grains in an Y-axis direction.

The rare-earth magnet has an average distance between crystal grains in the X-axis direction which is 0.95~1.05 times compared to an average distance between crystal grains in the Y-axis direction.

Advantageous Effects

In the rare-earth magnet and the method for manufacturing the same according to the present invention, since the biaxial molding is performed in the process of compacting and molding the raw material powder for the rare-earth magnet in a magnetic field, an average distance between crystal grains is uniform and the alignment characteristics in a magnetic field are excellent, the residual magnetic flux density is improved and therefore, the maximum energy product is improved.

DESCRIPTION OF DRAWINGS

The above and other features and advantages of the present invention will become more apparent by describing in detail exemplary embodiments thereof with reference to the attached drawing(s) in which.

MODE FOR INVENTION

Figure 1:
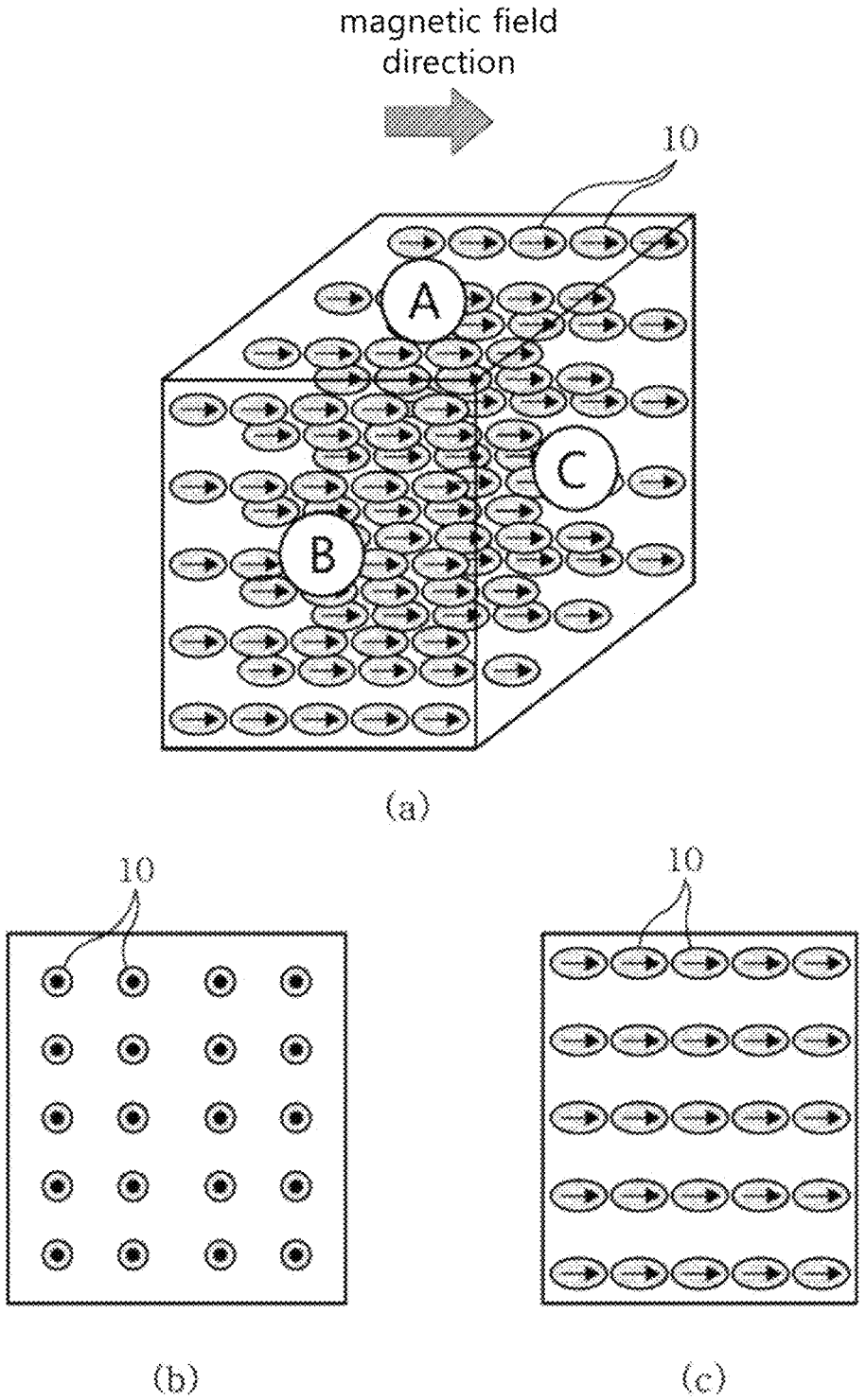
FIG. 1 is a schematic diagram of compacting and molding in a magnetic field according to the conventional art.
Figure 2:
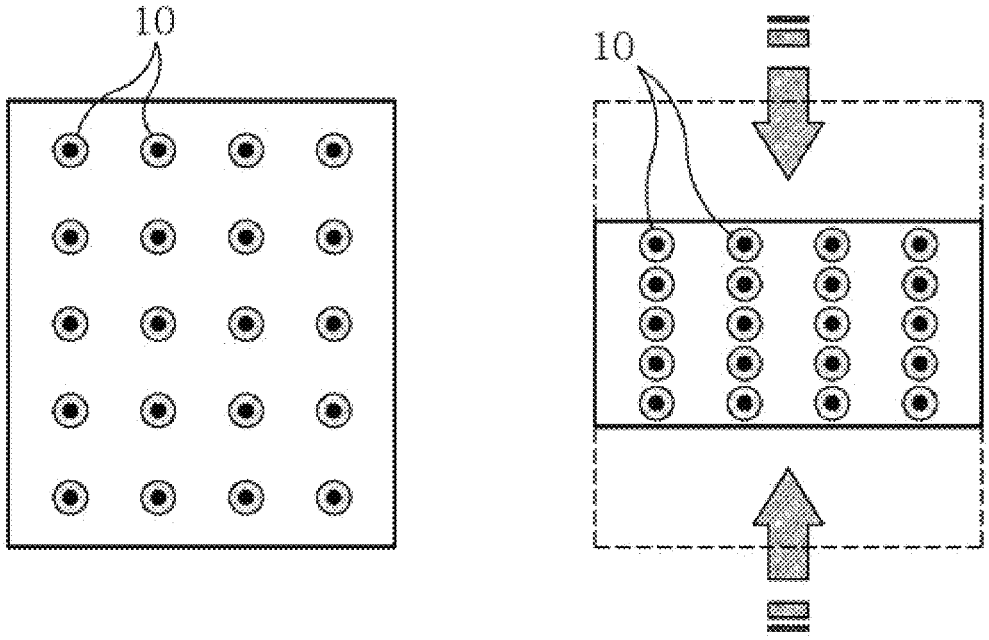
FIGS. 2 through 6 illustrate compacting and molding in a magnetic field according to an embodiment of the present invention.

The present invention will now be described more fully hereinafter with reference to the accompanying drawing(s), in which preferred embodiments of the invention are shown.

The terminology used herein is for the purpose of describing a particular embodiment(s) only and is not intended to be limiting of exemplary embodiments of the invention. It will be understood that the terms "comprises", "comprising", "includes" and/or "including" when used herein, specify the presence of stated features, integers, steps, operations, elements, and/or components, but do not preclude the presence or addition of one or more other features, integers, steps, operations, elements, components and/or groups thereof, unless the context clearly indicates otherwise.

A method for manufacturing a rare-earth magnet according to an embodiment of the present invention comprises the steps of: preparing a raw material powder for a rare-earth magnet including composition elements of R, Fe and B (wherein R is at least one element selected from rare-earth elements including Y and Sc); packing the raw material powder into a molding die; and forming a magnetic field and compacting and molding the powder, wherein, in the compacting and molding step, when a magnetic field direction is a Z-axis, the compacting is performed biaxially, in an X-axis direction and a Y-axis direction. After the molding is finished, the compact is sintered to produce the rare-earth magnet.

Each step will be described in detail below:

(1) Step of Preparing a Raw Material Powder for a Rare-Earth Magnet

In the raw material powder for a rare-earth magnet including R, Fe and B as composition components, R may be at least one element selected from rare-earth elements including Y and Sc, and at least one metal (M) may be selected as the composition components. Metals (M) may be Al, Ga, Cu, Ti, W, Pt, Au, Cr, Ni, Co, Ta, Ag, etc. Although the raw material powder is not limited, an Nb—Fe—B based sintered magnet powder may be used.

The raw material powder composition is not limited, however, R is 27~36 wt %, M is 0~5 wt %, B is 0~1 wt %, and Fe is the remainder.

In one exemplary embodiment, an alloy of the composition is melted by a vacuum induction heating method and is prepared as an alloy ingot by a strip casting method. A hydrogenation treatment and dehydrogenation treatment [hydrogenation-disproportionation-desorption-recombination (HDDR)] process is performed to the alloy ingot in the range of room temperature to 600° C. to improve the crushability of the alloy ingot, and subsequently, the alloy ingot is prepared as a uniform and fine powder with a particle size of 1~10 μm by using a pulverizing method, such as a jet mill, Attritor grinding mill, ball mill, vibration mill, etc. Preferably, the process of preparing the alloy ingot to the powder with the size of 1~10 μm is performed in a nitrogen or inert gas atmosphere to prevent the deterioration of magnetic properties by contamination with oxygen.

(2) Step of Packing the Raw Material Powder into a Molding Die

The raw material powder is packed into a molding die. The shape of the molding die is not limited and for example, it may be hexahedral. The packing density is not limited, however, it is excellent to pack the raw material powder into the molding die within the range of 1.0 g/cc to 3.0 g/cc and, preferably, it is better to do so within the range of 1.5 g/cc to 2.5 g/cc, as shown in the examples to be later described. When the packing density is not within the aforementioned range, the alignment characteristics of the powder in a magnetic field may be relatively bad.

(3) Step of Compacting and Molding the Raw Material Powder as a Compact in a Magnetic Field The raw material powder packed into the molding die is molded in a magnetic field. In the step of compacting and molding the raw material powder in a magnetic field according to the embodiment of the present invention, the powder is compacted biaxially. Preferably, a green density of the molded powder is 3.5 g/cc to 4.5 g/cc. In this range, the maximum energy production of the magnet is excellent. Further, preferably, the process of molding the powder in a magnetic field is performed in a nitrogen or inert gas atmosphere to prevent the deterioration of magnetic properties by contamination with oxygen.

FIG. 1 is a conceptual diagram of the compacting and molding of the raw material powder 10 in a magnetic field. In FIG. 1 (*a*) when a magnetic field direction is a Z-axis in molding the raw material powder 10 in a magnetic field, C is defined as a vertical section of the Z-axis, A is defined as a vertical section of the X-axis and B is defined as a vertical section of the Y-axis. FIG. 1 (*b*) is a vertical section of C and FIG. 1 (*c*) is a vertical section of A or B. In the embodiment of the present invention, the compacting and molding is performed biaxially, in the X-axis and Y-axis directions while forming the magnetic field in the Z-axis direction. Although the X-axis, Y-axis and Z-axis are illustrated to be perpendicular to one another in the drawings, the present invention includes the case where these axes are diagonally inclined. That is, the present invention includes the case where all of the magnetic field direction, X-axis compacting direction and Y-axis compacting direction may not be perpendicular to one another.

The X-axis and Y-axis are based on not the molding die but the magnet to be molded and manufactured. Therefore, the biaxial compacting includes the case where, after the magnet is compacted uniaxially, the magnet is rotated by 90° and again compacted using the same press.

Preferably, the difference in a ratio of compacting in the X-axis direction to the Y-axis direction is 10% or less, and more preferably, the compacting ratio is the same.

Figure 3:
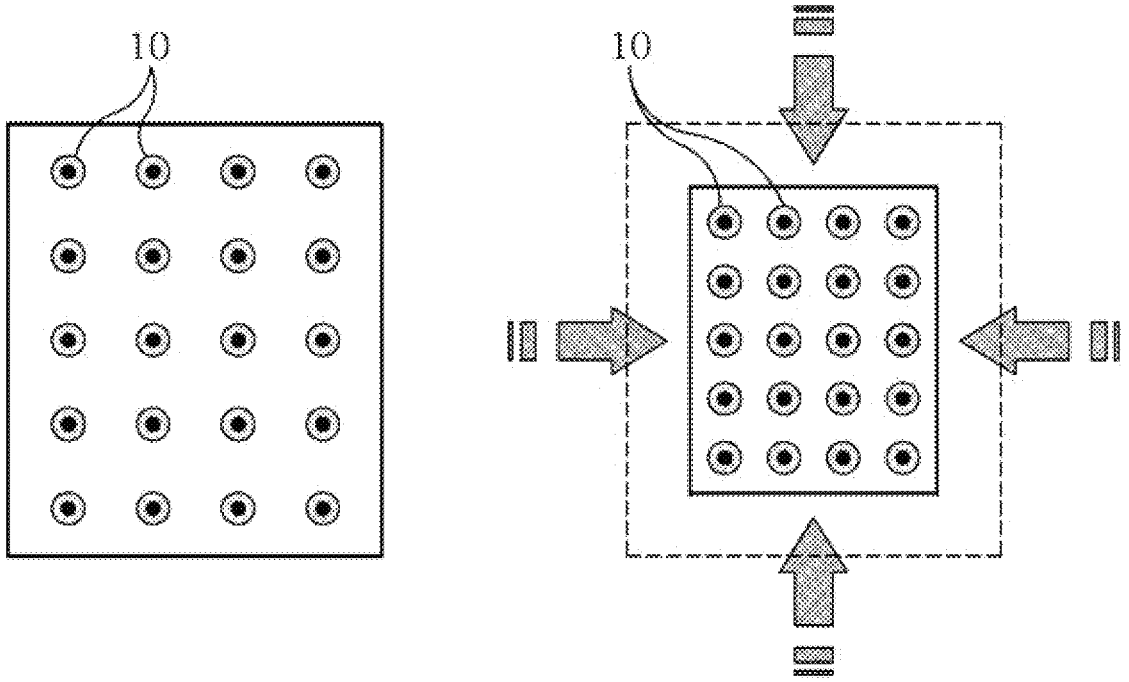
Figure 4:
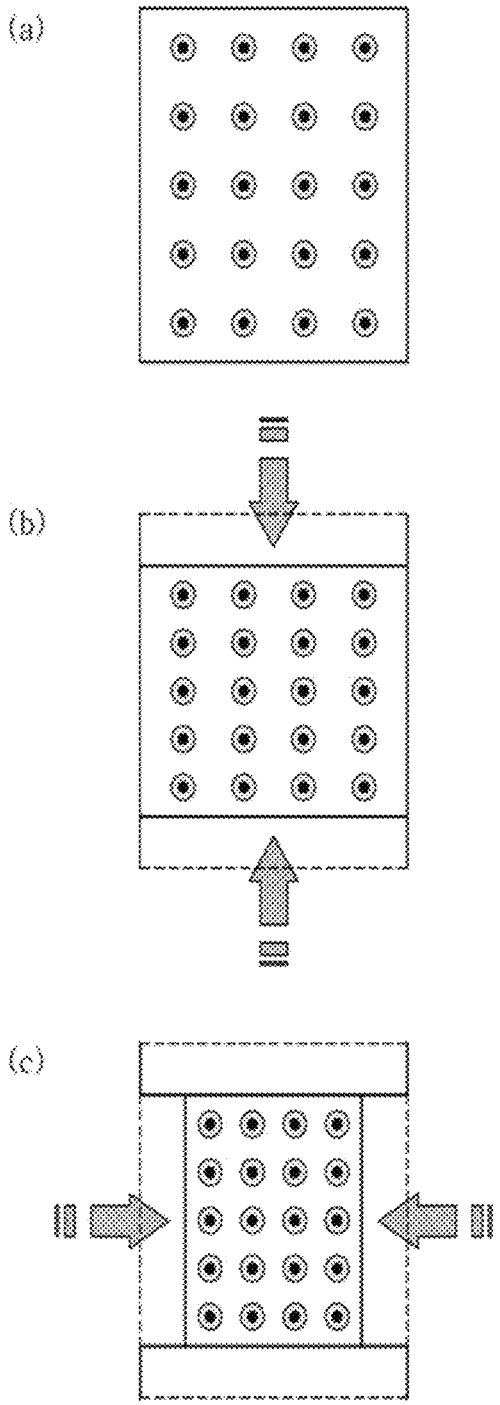

FIG. 3 is a sectional view of C, wherein the compacting and molding are performed biaxially, in the X-axis and Y-axis directions. The compacting in the X-axis direction and the Y-axis direction are simultaneously or sequentially performed. Specifically, as shown in FIG. 4, the compacting in the X-axis (or Y-axis) direction can be performed after the compacting in the Y-axis (or X-axis) direction. The compacting in the X-axis and in the Y-axis direction is respectively performed by one (1) time sequentially, to finish the compacting and molding.

Figure 5:
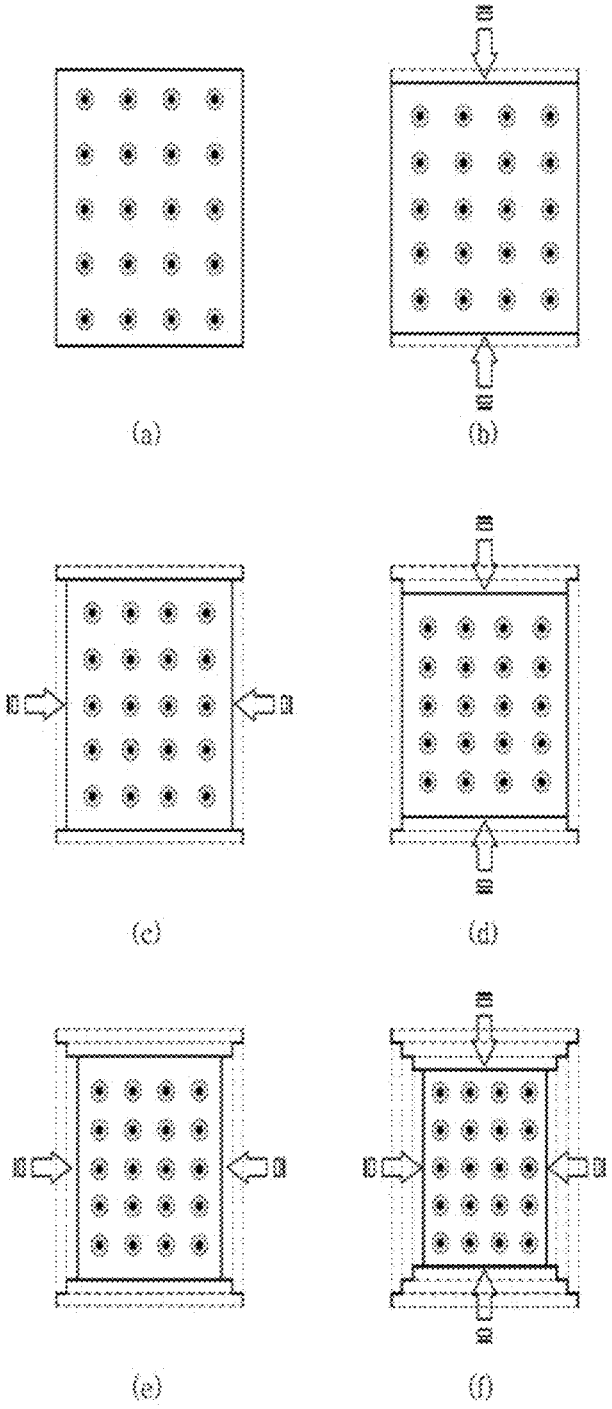
Figure 6:
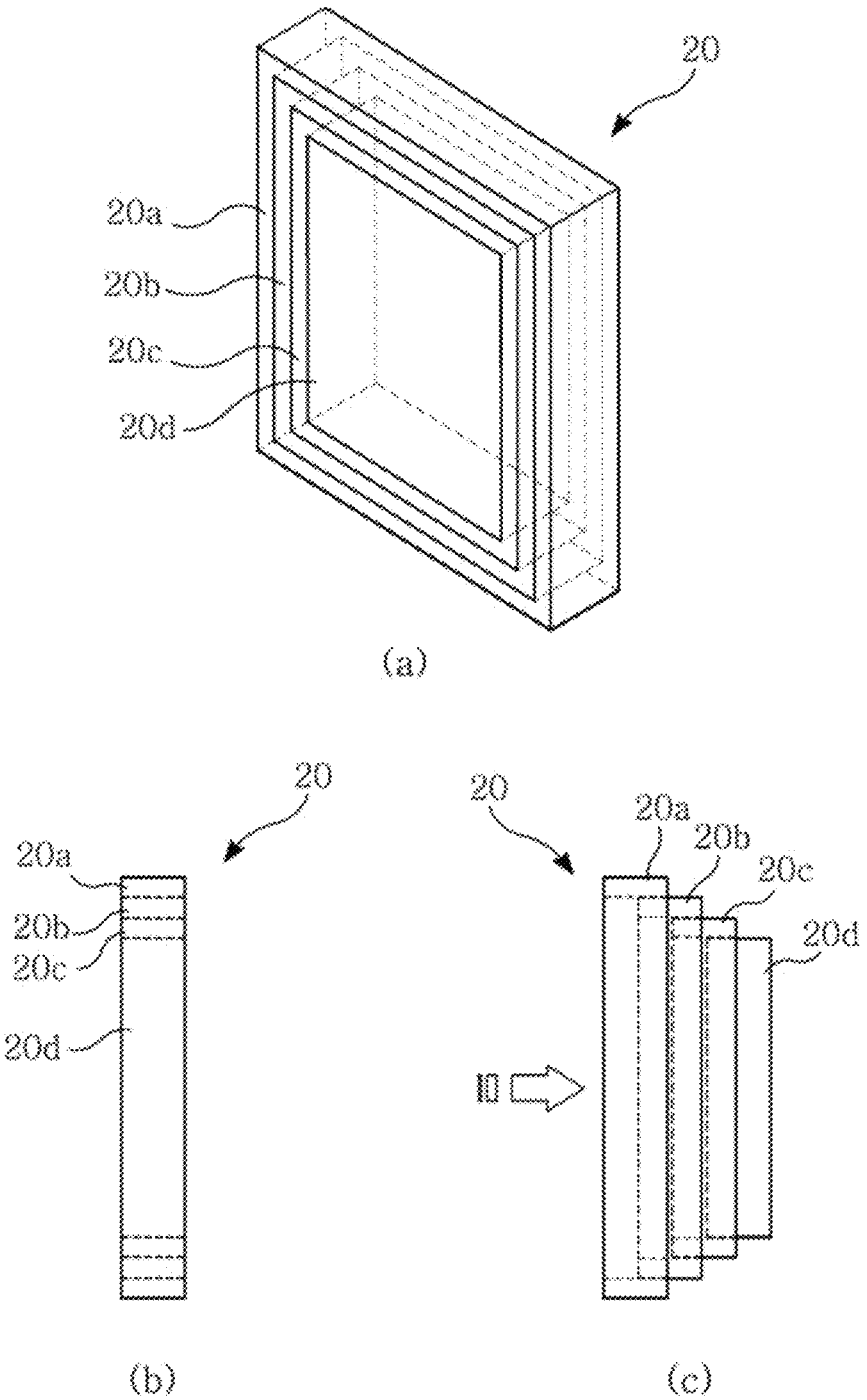

As shown in FIG. 5, the compacting and molding may be finished by sequentially compacting in the X-axis direction and the Y-axis direction repeatedly by two (2)~ten (10) times (FIG. 5 shows three (3) time-repeat), to enable a more uniform compact and attain excellent alignment characteristics of the powder, compared to the one (1) time-compact The shape of a pressing plate is not limited and a pressing plate 20 in the shape shown in FIG. 6 may be used. To prevent the interference between the presses upon the biaxial compacting process, the pressing plates 20 are separated as shown such that the pressing plate 20*a*, 20*b*, 20*c*, 20*d* may be formed to press sequentially, starting with the pressing plate which has a larger area.

In FIGS. 3 through 5, although the pressing is performed in both directions during the compacting process, the present invention is not limited thereto. One side may be fixed and the other side may be pressed.

Once the biaxial compacting and molding process in a magnetic field is completed in the aforementioned manner, it is better to sinter the compact. In the sintering step, a temperature for heat treatment and a heating rate are very important. As shown in the examples to be later described, preferably, sintering the compact is performed at 900~1,100° C. and the heating rate at 700° C. or above is adjusted within 0.5~15° C./min.

As one example, the compact obtained by the molding method in a magnetic field is loaded into a sintering furnace and sufficiently maintained at 400° C. or below, under a vacuum, so that any remaining impure organic matters are completely removed. Again, the compact is maintained for 1~4 hours by increasing the temperature to the range of 900~1,100° C., thereby completing the sintering densification. Preferably, the sintering process is performed under a vacuum or in an inert gas atmosphere, like argon. At 700° C. or above, a heating rate is controlled to be 0.1~10° C./min, preferably, 0.5~15° C./min.

Selectively, it is better to perform a post heat treatment at 400~900° C. for 1~4 hours, to stabilize the sintered compact. Then, the compact is processed to a predetermined size, to be manufactured as a rare-earth magnet.

In the rare-earth magnet manufactured by the aforementioned method, the average distance between the crystal grains in the X-axis direction is within the range of 0.90~1.10 times, specifically 0.95~1.05 times, compared to the average distance between the crystal grains in the Y-axis direction, so that the crystal grains are very uniformly distributed and therefore the magnetic properties are significantly improved.

The present invention will be more fully described with reference to the examples below:

Example 1

An alloy composed of 32 wt % RE-66 wt % Fe-1 wt % TM-1 wt % B (wherein RE is a rare-earth element, and TM is a 3d transition metal) was melted by a vacuum induction heating method and was manufactured as an alloy ingot by using a strip casting method. To improve the crushability of the alloy ingot, the alloy ingot was subjected to a process of absorbing hydrogen in a hydrogen atmosphere at room temperature and removing hydrogen under a vacuum at 600° C. [hydrogenation-disproportionation-desorption-recombination (HDDR)]. Subsequently, the alloy ingot was prepared as a uniform and fine powder with a particle size of 3.5 μm by a pulverizing method using the jet mill technique. The process of preparing the fine powder from the alloy ingot was performed in a nitrogen or inert gas atmosphere, to prevent the deterioration of magnetic properties by contamination with oxygen.

The pulverized rare-earth powder was uniformly packed into a molding die with a size of 20 mm*20 mm*20 mm within a packing density range of 2.0 g/cc. Compacting and molding were performed by applying the magnetic field of 2 Tesla at electromagnets positioned at the right and left of the mold. Pressing was performed in the two directions (X-axis and Y-axis) perpendicular to the direction of applying a magnetic field (Z-axis) and molding was performed in each of the two directions at the same compacting ratio, to make a molded compact having the final green density of 4.0 g/cc. In a comparative example, during the compacting and molding process, pressing was performed in anyone direction (X-axis or Y-axis) of the two directions perpendicular to the direction of applying a magnetic field (Z-axis), to manufacture a molded compact having the final green density of 4.0 g/cc.

The compact obtained by the aforementioned biaxial molding technique in a magnetic field was loaded into a sintering furnace and sufficiently maintained at 400° C. or below, under a vacuum, so that any remaining impure organic matters were completely removed. Again, the compact was maintained for 2 hours by increasing the temperature to the range of 1,060° C., thereby completing the sintering densification. The compact was heat-treated at 500° C. for 2 hours and manufactured as a magnet.

The magnetic properties of the samples carried out according to the present invention and the comparative samples were obtained by measuring each loop by applying a maximum magnetic field of 30 kOe by the B—H loop tracer. The average distance ratio between crystal grains was obtained by the average distance between the centers of the crystal grains based on the vertical section photo of a magnetic field. The results are shown in Table 1. It is confirmed that the alignment characteristics in a magnetic field was improved by the biaxial molding and the residual magnetic flux density was significantly improved.

TABLE 1

| Sample | Powder packing density (g/cc) | Magnetic field direction | Pressing direction | Compacting ratio | Powder green density (g/cc) | Average distance ratio between crystal grains (X-axis:Y-axis) | Residual magnetic flux density, (kG) | Maximum energy production (MGOe) |
|---|---|---|---|---|---|---|---|---|
| 1-1 (comparative example) | 2 | Z-axis | X-axis | — | 4 | 1.00:1.12 | 13.2 | 44.4 |
| 1-2(comparative example) | 2 | Z-axis | Y-axis | — | 4 | 1.13:1.00 | 13.2 | 44.4 |
| 1-3(embodiment example) | 2 | Z-axis | X-axis and Y-axis | 1:1 | 4 | 1.00:1.03 | 14.0 | 48.0 |

Example 2

Example 2 was carried out in the same manner as in Example 1, except that the powder packing density was different. The results are shown in Table 2 below. It is found that surprisingly, the powder packing density importantly influenced on the alignment characteristics in a magnetic field. The alignment characteristics were most excellent within the rage of 1.5~2.5 g/cc. Although it is not shown in this Table, the residual magnetic flux density noticeably decreased when the powder packing density was less than 1.0 g/cc and more than 3.0 g/cc.

TABLE 2

| Sample | Powder packing density (g/cc) | Magnetic field direction | Pressing direction | Compacting ratio | Powder green density (g/cc) | Residual magnetic flux density, (kG) | Maximum energy production (MGOe) |
|---|---|---|---|---|---|---|---|
| 2-1(comparative example) | 1.0 | Z-axis | X-axis | — | 4 | 13.0 | 41.4 |
| 2-2(comparative example) | 1.5 | Z-axis | X-axis | — | 4 | 13.1 | 42.1 |
| 2-3(comparative example) | 2.0 | Z-axis | X-axis | — | 4 | 13.2 | 44.4 |
| 2-4(comparative example) | 2.5 | Z-axis | X-axis | — | 4 | 13.0 | 41.4 |
| 2-5(comparative example) | 3.0 | Z-axis | X-axis | — | 4 | 12.5 | 38.3 |
| 2-6(embodiment example) | 1.0 | Z-axis | X-axis and Y-axis | 1:1 | 4 | 13.8 | 46.7 |
| 2-7(embodiment example) | 1.5 | Z-axis | X-axis and Y-axis | 1:1 | 4 | 13.9 | 47.4 |
| 2-8(embodiment example) | 2.0 | Z-axis | X-axis and Y-axis | 1:1 | 4 | 14.0 | 48.0 |
| 2-9(embodiment example) | 2.5 | Z-axis | X-axis and Y-axis | 1:1 | 4 | 13.8 | 46.7 |
| 2-10 (embodiment example) | 3.0 | Z-axis | X-axis and Y-axis | 1:1 | 4 | 13.5 | 44.7 |

Example 3

Example 3 was carried out in the same manner as in Example 1, except that the powder green density was different. The results are shown in Table 3 below. When the powder green density was 3.5~4.5 g/cc, the alignment characteristics in a magnetic field were excellent.

TABLE 3

| Sample | Powder packing density (g/cc) | Magnetic field direction | Pressing direction | Compacting ratio | Powder green density (g/cc) | Residual magnetic flux density, (kG) | Maximum energy production (MGOe) |
|---|---|---|---|---|---|---|---|
| 3-1(comparative example) | 2.0 | Z-axis | X-axis | — | 3.5 | 13.4 | 44.0 |
| 3-2(comparative example) | 2.0 | Z-axis | X-axis | — | 4 | 13.2 | 44.4 |

TABLE 3-continued

| Sample | Powder packing density (g/cc) | Magnetic field direction | Pressing direction | Compacting ratio | Powder green density (g/cc) | Residual magnetic flux density, (kG) | Maximum energy production (MGOe) |
|---|---|---|---|---|---|---|---|
| 3-3(comparative example) | 2.0 | Z-axis | X-axis | — | 4.5 | 13.0 | 41.2 |
| 3-4(embodiment example) | 2.0 | Z-axis | X-axis and Y-axis | 1:1 | 3.5 | 14.2 | 49.4 |
| 3-5(embodiment example) | 2.0 | Z-axis | X-axis and Y-axis | 1:1 | 4 | 14.0 | 48.0 |
| 3-6(embodiment example) | 2.0 | Z-axis | X-axis and Y-axis | 1:1 | 4.5 | 13.8 | 46.7 |

While the present invention has been particularly shown and described with reference to examples thereof, it will be understood by those of ordinary skill in the art that various modifications and alternative arrangements in form and details may be made therein without departing from the spirit and scope of the present invention as defined by the following claims. The scope of the claims, therefore, should be accorded the broadest interpretation so as to encompass all such modifications and similar arrangements.

The invention claimed is:

1. A method for manufacturing a rare-earth magnet, comprising the steps of:

preparing a raw material powder for the rare-earth magnet, the raw material powder comprising R, Fe and B, wherein R is at least one element selected from rare-earth elements including Y and Sc;

packing the raw material powder into a molding die; and compacting and molding the raw material powder by forming a magnetic field, wherein, in the compacting and molding step, when a direction of the magnetic field is a Z-axis, the compacting is performed along directions of an X-axis and a Y-axis, wherein the compacting is sequentially and repeatedly performed along the X-axis direction and the Y-axis direction, two to ten times, respectively, wherein the compacting is performed by using a plurality of X-axis pressing plates moving along the X-axis direction, and a plurality of Y-axis pressing plates moving along the Y-axis direction, wherein the plurality of X-axis and Y-axis pressing plates are respectively separable and each pressing plate has varying sizes of pressing area, and the compacting is performed by using sequentially from pressing plates having a larger pressing area to pressing plates having a smaller pressing area of the plurality of X-axis and Y-axis pressing plates, and wherein a difference in a ratio of the compacting in the X-axis direction to the Y-axis direction is 10% or less.

2. The method of claim 1, wherein, after the step of compacting and molding is performed, a powder green density of the raw material power is 3.5~4.5 g/cc.

3. The method of claim 1, wherein the packing is performed within a packing density of 1.0~3.0 g/cc.

4. The method of claim 1, wherein an average distance between crystal grains in the X-axis direction is 0.90~1.10 times compared to an average distance between crystal grains in the Y-axis direction.

5. The method of claim 1, wherein the X-axis pressing plates and the Y-axis pressing plates compact the raw material powder in an alternating sequence.

* * * * *